US009212498B2

(12) United States Patent
Pichon et al.

(10) Patent No.: US 9,212,498 B2
(45) Date of Patent: Dec. 15, 2015

(54) SELF-PROPELLED APPARATUS FOR CLEANING A SUBMERGED SURFACE

(75) Inventors: Philippe Pichon, Villeneuve de Riviere (FR); Philippe Blanc-Tailleur, Toulouse (FR); Emmanuel Mastio, East Lindfield (AU)

(73) Assignee: ZODIAC POOL CARE EUROPE, Paris (FR)

( * ) Notice: Subject to any disclaimer, the term of this patent is extended or adjusted under 35 U.S.C. 154(b) by 362 days.

(21) Appl. No.: 13/805,347

(22) PCT Filed: Jun. 24, 2011

(86) PCT No.: PCT/FR2011/051471

§ 371 (c)(1), (2), (4) Date: Feb. 11, 2013

(87) PCT Pub. No.: WO2011/161389

PCT Pub. Date: Dec. 29, 2011

(65) Prior Publication Data

US 2013/0133145 A1 May 30, 2013

(30) Foreign Application Priority Data

Jun. 25, 2010 (FR) ..... 10 02666

(51) Int. Cl.
*E04H 4/16* (2006.01)

(52) U.S. Cl.
CPC ..... *E04H 4/16* (2013.01); *E04H 4/1654* (2013.01); *E04H 4/1663* (2013.01); *E04H 4/1618* (2013.01); *E04H 4/1636* (2013.01)

(58) Field of Classification Search
CPC ..... E04H 4/16; E04H 4/1618; E04H 4/1654; E04H 4/1663; E04H 4/169; E04H 4/1636
USPC ..... 15/1.7
See application file for complete search history.

(56) References Cited

U.S. PATENT DOCUMENTS 5,001,800 A * 3/1991 Parenti et al. ..... 15/1.7
5,097,559 A * 3/1992 Brunt et al. ..... 15/1.7

(Continued)

FOREIGN PATENT DOCUMENTS

CH 648893 A5 4/1985
EP 0483470 A1 5/1992

(Continued)

OTHER PUBLICATIONS

International Search Report dated Sep. 2, 2011 in Application No. PCT/FR2011/051471.

*Primary Examiner* — Michael Jennings
(74) *Attorney, Agent, or Firm* — Dean W. Russell; Kilpatrick Townsend & Stockton LLP

(57) ABSTRACT

A self-propelled apparatus for cleaning an immersed surface including a hollow body, a guiding and driving device for guiding and moving the hollow body over the immersed surface, the hollow body having a base immediately facing immersed surface, at least one liquid inlet, at least one member protruding from the base of the hollow body towards the immersed surface, wherein it includes, immediately in front of a protruding member, in a movement direction of the hollow body, at least one member, called an anti-blocking member, which can rotate about a rotation axis which is fixed in relation to said protruding member, the anti-blocking member being provided in order to be able to roll over an obstacle of the immersed surface, and to drive the protruding member in movement so as to overcome the obstacle.

10 Claims, 5 Drawing Sheets

(56) References Cited

U.S. PATENT DOCUMENTS

| | | | | |
|---|---|---|---|---|
| 5,099,535 | A * | 3/1992 | Chauvier et al. | 15/1.7 |
| 5,172,445 | A * | 12/1992 | Chandler | 15/1.7 |
| 5,197,158 | A * | 3/1993 | Moini | 15/1.7 |
| 5,245,723 | A | 9/1993 | Sommer | |
| 5,617,600 | A * | 4/1997 | Frattini | 15/1.7 |
| 5,655,246 | A * | 8/1997 | Chang | 15/1.7 |
| 5,771,987 | A * | 6/1998 | Marbach | 180/6.66 |
| 6,854,148 | B1 * | 2/2005 | Rief et al. | 15/1.7 |
| 7,464,429 | B2 * | 12/2008 | Stoltz | 15/1.7 |
| 8,117,704 | B2 * | 2/2012 | Schneider et al. | 15/1.7 |
| 8,341,789 | B2 * | 1/2013 | Garti | 15/1.7 |
| 2006/0225768 | A1 * | 10/2006 | Erlich et al. | 134/6 |
| 2007/0157413 | A1 | 7/2007 | Roumagnac | |
| 2009/0300862 | A1 * | 12/2009 | Schneider et al. | 15/1.7 |
| 2010/0306931 | A1 * | 12/2010 | Garti | 15/1.7 |

FOREIGN PATENT DOCUMENTS

| | | |
|---|---|---|
| EP | 1290293 B1 | 3/2003 |
| FR | 2567552 | 1/1986 |
| FR | 2584442 | 1/1987 |
| FR | 2896005 A1 | 7/2007 |

* cited by examiner

SELF-PROPELLED APPARATUS FOR CLEANING A SUBMERGED SURFACE

CROSS REFERENCE TO RELATED APPLICATIONS

This application is the U.S. national phase of International Application No. PCT/FR2011/051471 filed on Jun. 24, 2011, which claims priority to French Patent Application No. 10/02666 filed on Jun. 25, 2010, the contents of both of which are incorporated herein by reference.

FIELD OF THE INVENTION

The invention relates to a self-propelled apparatus for cleaning a surface which is immersed in a liquid, such as a surface which is formed by the walls of a swimming pool, and more specifically such an apparatus of the type comprising a member which protrudes from the base thereof towards the immersed surface.

BACKGROUND OF THE INVENTION

There are known cleaning apparatuses (cf., for example, FR 2 567 552, FR 2 584 442, etc.) which comprise a hollow body; one or more device(s) for guiding and driving said hollow body over the immersed surface; and a pumping device which drives a pumping member such as a propeller which generates a flow of liquid between at least one liquid inlet and at least one liquid outlet of the hollow body, and through a filtration chamber.

Some known apparatuses have one or more member(s) which protrude(s) from their base towards the immersed surface. The protruding members, when they are not motors, may have varied functions such as friction for the purposes of cleaning the immersed surface, guiding and/or confinement of the liquid towards the liquid inlet of the apparatus, etcetera. EP 1 290 293 provides an example of such apparatuses.

When such apparatuses which have at least one non-motorized member which protrudes from the base thereof have a limited driving power, the problem arises of such a protruding member, and therefore the apparatus, becoming blocked on obstacles at the base, such as bottom plugs or changes of gradient.

It is desirable to provide these apparatuses with a drive power which is as low as possible in order to reduce their energy consumption and their production cost, in particular in apparatuses which are provided with a drive device of the electric motor type which is on-board the hollow body. The same problem occurs in the case of an apparatus with hydraulic propulsion (by means of reflux or suction), if the flow of liquid (which it is desirable to reduce for economic purposes) is not sufficiently great to provide the drive power required to overcome some obstacles.

Furthermore, the protruding portions of such an apparatus are capable of damaging the coatings of fragile surfaces, such as swimming pool liners, in particular at locations where the liners have obstacles or surface irregularities, such as folds, for example.

SUMMARY OF THE INVENTION

An object of the invention is therefore generally to overcome these disadvantages.

An object of the invention is therefore to provide a self-propelled apparatus for cleaning an immersed surface which comprises at least one member which protrudes from the base thereof and which is capable of overcoming any obstacle encountered over its path, without any risk of one of the protruding members thereof becoming blocked.

More specifically, an object of the invention is to provide such an apparatus which is economical in terms of production, use and maintenance, and which at the same time has high performance levels which are comparable with those of known apparatuses in terms of cleaning quality. An object of the invention is in particular to provide such an apparatus which carries out complete and rapid sweeping of the immersed surface, with good suction quality for collecting waste and a satisfactory performance level in terms of energy.

An object of the invention is also to provide such an apparatus which is particularly simple, compact and light but which is capable of passing obstacles of the immersed surface which it encounters.

An object of the invention is also in particular to provide such an apparatus which may be provided with at least one protruding cleaning member which comes into contact with the immersed surface, in particular which is capable of scraping it, rubbing it and/or brushing it and thus improving the cleaning thereof.

The invention therefore relates to a self-propelled apparatus for cleaning an immersed surface comprising:

- a hollow body,
- a device for guiding and driving the hollow body in a movement over the immersed surface, said hollow body having a base immediately facing but spaced-apart from said immersed surface,
- at least one liquid inlet at the base of the hollow body,
- at least one protruding member which protrudes from the base of the hollow body towards the immersed surface, wherein it comprises, immediately in front of a protruding member, according to a movement direction of the hollow body, at least one member, called an anti-blocking member, which can rotate about a rotation axis which is fixed relative to said protruding member, said anti-blocking member being provided so as to be able to roll over an obstacle of the immersed surface and to move said protruding member in order to overcome the obstacle.

In particular, advantageously and according to the invention, the protruding member can be moved relative to the hollow body. In particular, advantageously and according to the invention, it can be at least partially retracted into a recess of the hollow body. In this manner, advantageously and according to the invention, the protruding member protrudes less (or no longer protrudes) from the hollow body when passing an obstacle.

Advantageously, when passing an obstacle, the protruding member is raised relative to the rolling plane of the apparatus; the rolling plane being defined by the contact points between the wheels of the apparatus and the immersed surface on which it can be moved. The protruding member is in particular, advantageously and according to the invention, moved by a tilting and/or translation movement, so as to be remote from the rolling plane.

The invention can be used equally well for an apparatus with driving which is at least partially hydraulic (that is to say, which results from a hydraulic reaction component which is generated by the flow of liquid generated by a pumping device and which leaves the hollow body in an orientation which is non-orthogonal relative to the rolling plane) and/or an apparatus with driving which is at least partially electric (that is to say, which results from at least one electric motorized member).

The driving and the pumping of liquid of such an apparatus may be achieved in multiple and various manners. For example:

- an on-board electric motor may serve to drive the apparatus over the immersed surface by means of mechanical transmission of the movement owing to one or more wheel(s), track(s) or roller(s), the pumping being ensured by a device external with respect to the apparatus, this simply being connected to the hydraulic circuit of the external device;
- an on-board electric motor may serve to pump liquid in the hydraulic circuit which passes through the apparatus, the driving of the apparatus over the immersed surface being ensured only by means of the circulation of liquid and in particular by the suction and the discharge of the liquid;
- an on-board electric motor may serve both to drive the apparatus over the immersed surface by means of mechanical transmission of the movement owing to one or more wheel(s), track(s) or roller(s), and to pump the liquid in the hydraulic circuit which passes through the apparatus;
- the driving of the apparatus over the immersed surface and the circulation of fluid within the apparatus may both be carried out simultaneously by means of a device external with respect to the apparatus in accordance with the invention,
- the driving of the apparatus over the immersed surface and the circulation of fluid within the apparatus may be carried out by a combination of the means set out in the preceding examples, or by any other appropriate means.

An anti-blocking member according to the invention is capable of rolling, in particular rolling without sliding. That is to say that it has surface properties such that it can apply friction to a solid surface, and in particular to an immersed surface.

Furthermore, an anti-blocking member according to the invention can be rotated about a shaft, which allows it to roll. The shaft of such an anti-blocking member is at least substantially orthogonal, in a plane at least substantially parallel with the immersed surface on which the apparatus moves, relative to at least one movement orientation of the hollow body over the immersed surface. This allows such an anti-blocking member to roll over an obstacle which is encountered in particular by the front in a movement direction of the movement orientation of the hollow body of an apparatus according to the invention.

Advantageously and according to the invention, the rotation shaft of the anti-blocking member is fixed relative to the protruding member.

In an apparatus according to the invention, an anti-blocking member is placed in front of a protruding member, in accordance with a possible movement direction of the cleaning apparatus in which the protruding member is capable of becoming blocked on an obstacle and in which the blocking of the protruding member is not a desired effect. If a protruding member is capable of overcoming an obstacle in some movement directions of the apparatus without requiring any anti-blocking member, an anti-blocking member is not necessary (for example, a retracted protruding member when the apparatus moves in a specific direction, or a flexible protruding member in one movement direction, etcetera). Furthermore, the blocking of a protruding member on an obstacle is sometimes a desired effect (in order to turn the apparatus about this point of contact, for example) and, in this instance again, the arrangement of an anti-blocking member in front of a protruding member in this movement direction is not necessary.

On the other hand, the use of one or more anti-blocking member(s) according to the invention can be envisaged for all types of cleaning apparatuses which have a protruding member which is capable of becoming blocked on an obstacle and in which the blocking of the protruding member is not a desired effect.

Most often on apparatuses for cleaning an immersed surface, a preferred movement orientation is defined by the arrangement of the driving and/or guiding members (wheels, rollers, tracks, liquid discharge pipes, or the like), in particular by an axis which is at least substantially orthogonal relative to the rotation axe(s) of the driving member(s), for example, in the case of wheels. In this manner, one or more anti-blocking member(s) may be arranged at one side and the other of a protruding member at the front and the rear, respectively, in any movement direction in this preferred orientation, in order to allow the protruding member to pass obstacles in the two possible movement directions in this orientation.

In this manner, for example, if an apparatus according to the invention is able to move in two directions in the same orientation, if, in these two directions, the protruding member is capable of becoming blocked on an obstacle and if the blocking of the protruding member is not a desired effect, a protruding member may be provided at the front and at the rear with an anti-blocking member according to the invention.

The anti-blocking member according to the invention may optionally be movable with respect to the protruding member(s) which it allows to overcome obstacles, and may alternatively be located at one side and the other of the protruding member in accordance with the movement direction of the apparatus.

On the other hand, if the blocking is desired or provided in the concept of the apparatus, it may be sufficient to provide an anti-blocking member only in one movement direction in the preferred orientation. For example, according to a specific embodiment of the invention, an apparatus may be provided with a system for inverting the movement direction when it is blocked in a movement direction: it is then sufficient to provide an anti-blocking member at the front of a protruding member in the other movement direction in said preferred orientation.

In said preferred movement orientation, a movement direction is most often preferred for cleaning the immersed surface. A preferred movement direction for movement of the hollow body, and by extension of the apparatus, advantageously corresponds to a direction for cleaning the immersed surface by said cleaning apparatus.

However, there is nothing to prevent an apparatus according to the invention from being able to move and/or clean in more than one orientation and/or more than one movement direction on the immersed surface, for example, in accordance with a non-linear or even random trajectory.

In this instance, an anti-blocking member may be arranged at the front of a protruding member in a single preferred movement direction if the protruding member is not capable of becoming blocked in the other movement directions, or if the blocking thereof is a desired effect. Otherwise, any number of anti-blocking members, at the front of one or more protruding member(s) in any number of movement orientations and directions required may be envisaged: for example, an assembly of eight anti-blocking members on an apparatus which can move in the two directions of four orientations. On a rotating apparatus, an anti-blocking member may be arranged at the front of a protruding member in accordance with one or both rotation directions of the apparatus.

Furthermore, advantageously according to the invention, the rotation axis of an anti-blocking member is also substantially parallel with the immersed surface when the cleaning apparatus is placed thereon.

In particular, an anti-blocking member which is capable of rolling over an obstacle of the immersed surface and which is placed at the front in a preferred movement direction of a protruding member assists it in passing the obstacle by moving and in particular by raising at least a portion of the apparatus comprising said protruding member. Such an anti-blocking member moves at least the protruding member in order to allow it to overcome the obstacle. When an obstacle is passed, the protruding member is moved relative to the body of the apparatus, in particular relative to the rolling plane of the apparatus, in order to facilitate the passage of an obstacle.

Furthermore, according to a specific embodiment of the invention, an anti-blocking member and/or the arrangement of this anti-blocking member may be such that at least one member of an apparatus according to the invention in contact with the immersed surface during a cleaning movement without obstacles is/are no longer in contact during the passage of an obstacle, that is to say, said anti-blocking member allows a portion of the apparatus to be raised relative to the immersed surface. In particular, an anti-blocking member according to the invention may allow at least one driving member of the apparatus to be raised (for example, a drive wheel) when some obstacles are passed, thereby introducing an imbalance of the position and the drive component of the apparatus.

A plurality of anti-blocking members may be provided around and in the proximity of the same protruding member, in particular if the apparatus is capable of moving in more than one direction. In the same manner, if the apparatus is capable of moving in a plurality of orientations, it may be advantageous to arrange anti-blocking members around a protruding member whose rotation axes will be different from each other and substantially orthogonal to a possible movement orientation of the apparatus.

Furthermore, the movement of at least one protruding member by the rolling of an anti-blocking member on an obstacle may be carried out in accordance with several types of movement: rotation, translation or another type.

Advantageously, an apparatus according to the invention has at least one support which is common to at least one protruding member and at least one anti-blocking member, said support being articulated relative to the hollow body along an axis, called a tilting axis, which is substantially parallel with the rotation axis of at least one of the anti-blocking members supported by said common support.

In particular a common support according to the invention has a tilting axis at the front of at least one anti-blocking member in a movement direction of the hollow body. Advantageously, the tilting axis of such a common support is located at the front of at least one anti-blocking member, which is itself located at the front of at least one protruding member in a movement direction of the hollow body, in particular in a preferred cleaning direction; the tilting axis and the rotation axis (or axes) of the anti-blocking member(s) being substantially orthogonal to the same movement direction of the hollow body.

The function of such a common articulated support is to allow the tilting relative to the hollow body of the assembly constituted by at least one anti-blocking member and at least one protruding member. This tilting, when an obstacle is located on the trajectory of the anti-blocking member, allows the anti-blocking member to be placed in rolling contact on the obstacle and thus allows the support and each protruding member that it supports at the rear of this anti-blocking member to be raised. The passage of obstacles by the protruding member(s) is thus facilitated.

Furthermore, according to the invention, there is nothing to prevent the provision of a device for resiliently returning scrapers into a scraping position on the immersed surface. Such a device would have the function of ensuring that the scrapers apply a non-zero normal component force to the immersed surface. For example, such a device may have one or more spring(s) in the region of the articulation of the common support.

Furthermore, advantageously and according to the invention, such a common support comprises a lower stop and an upper stop which are capable of limiting the angular extent of the tilting of said common support.

The lower stop has the main function of preventing an anti-blocking member or a protruding member from becoming damaged during transport of the apparatus. When the apparatus is handled by a user, a common articulated support as defined by the invention protrudes relative to the hollow body of the apparatus. It protrudes even further if it comprises a device for resiliently returning the scrapers which has the effect of correctly retaining the scrapers in contact with the immersed surface during the cleaning thereof. Since it protrudes from the apparatus when it is handled, such a common support is capable of becoming damaged. Therefore, the lower stop has the function of limiting the protrusion of such a common support.

Furthermore, such a lower stop prevents the assembly of anti-blocking member(s) and protruding member(s) mounted on a common support from becoming overturned when handled by a user, which would bring about an operational fault of the apparatus, in particular a blockage of the apparatus on any obstacle, decreased cleaning capacity, or even damage to a portion of the assembly of anti-blocking member(s) and protruding member(s) and/or a fragile coating of the immersed surface, such as swimming pool liners, for example, in particular at the locations where they have surface irregularities (for example, folds).

Furthermore, the lower stop may have an effect of retaining the assembly of anti-blocking member(s) and protruding member(s) mounted on a common support when at least one protruding member is in contact with the immersed surface and is subjected to a wear effect. Owing to wear of a protruding member which, owing to its contact with the immersed surface, represents the lower support of the assembly of anti-blocking member(s) and protruding member(s) mounted on a common support, this assembly would have a tendency to become progressively lower until the anti-blocking member is in permanent contact with the immersed surface. Since this effect is not desired, the lower stop may be produced so as to retain the anti-blocking member(s) above and out of contact with the immersed surface.

The upper stop has the function of preventing the assembly of anti-blocking member(s) and protruding member(s) mounted on a common support from becoming accommodated completely inside the hollow body and, where applicable, preventing it from overturning. Therefore, owing to the upper stop, the rolling function of the anti-blocking member is retained for the entire duration of the climbing on the obstacle. This rolling function on an obstacle, for some basic shapes of the hollow body and some obstacles, may allow an impact to be prevented between the base of the hollow body and the obstacle.

Advantageously, an apparatus according to the invention comprises at least one protruding member which is located near and behind a liquid inlet according to a movement direction of the apparatus corresponding to a cleaning of the immersed surface by means of suction of liquid into said liquid inlet.

Since an anti-blocking member is located immediately in front of a protruding member in a preferred movement direction of the apparatus, there is nothing to prevent it from being located immediately below a portion of the liquid inlet. However, advantageously and according to the invention, in order not to impair the suction of liquid via the liquid inlet, an anti-blocking member is located immediately to the rear of the liquid inlet (in the same preferred movement direction of the apparatus), the protruding member(s) in front of which it is located being offset towards the rear (still in the same preferred movement direction of the apparatus) by a distance in the order of the maximum diameter of said anti-blocking member.

Advantageously, an anti-blocking member according to the invention has a rotation axis which is orthogonal relative to a preferred movement orientation of the hollow body relative to the immersed surface.

However, there is nothing to prevent the rotation axes of different anti-blocking members from being parallel with each other, in particular if the apparatus can move over the immersed surface in several orientations.

An apparatus according to the invention may comprise protruding members having diverse and varied functions. These functions may directly relate to the cleaning of the immersed surface (scraper, brush, etc.), be indirectly used for the cleaning of the immersed surface, or have a function which is required for an apparatus according to the invention which would not be included in the two categories above.

Advantageously, an apparatus according to the invention comprises at least one protruding member which forms a cleaning scraper which is provided in order to scrape over the immersed surface, and at least one anti-blocking member which is associated with each cleaning scraper and which is located in front of each cleaning scraper in a preferred movement direction of the apparatus.

Such a scraper, which has a simple structure in comparison with other cleaning devices, in particular has the advantage of providing a simple, economical and efficient means for cleaning the immersed surface. The scraping allows contamination to be removed which would not be removed by simple suction of liquid. The friction on the immersed surface in particular allows the cleaning efficiency of an apparatus whose liquid suction power is limited to be improved. Contamination which may be bonded to the immersed surface and which could not be drawn in by the simple suction of liquid generated by the liquid inlet is placed in suspension in the liquid by the scraping effect of such a scraper. The contamination thus placed in suspension in the liquid is drawn by the suction of liquid towards the liquid inlet.

There is nothing to prevent different shapes of scrapers of different types from being provided. In this manner, the scraper(s) may be concave, straight, or of any shape. In the same manner, such a scraper may have a scraping edge which is straight, toothed, grooved, curved, etc.

A scraper according to the invention may be produced from different materials, preferably adapted to the immersed surface, in particular to the roughness thereof. Such a scraper may thus be rigid or flexible to a greater or lesser extent.

Furthermore, advantageously and according to the invention, a cleaning apparatus may comprise a plurality of scrapers which adjoin each other in extension of each other transversely relative to said movement direction in order to scrape the immersed surface over a major portion of the width of the hollow body.

Advantageously, an apparatus according to the invention may have an anti-blocking member immediately in front of each of the scrapers, or an anti-blocking member common to a plurality of scrapers. In the same manner, a plurality of anti-blocking members transversely one in extension of the other may be arranged at the front of a scraper in a preferred movement direction of the apparatus.

Scrapers according to the invention may each be mounted individually on a common support, or in groups on an assembly of common supports. In this manner, the passage of obstacles is carried out independently for each of the groups of scrapers mounted on the same common support, which is advantageous, in particular in the case of an obstacle which has a width which is much less than the width of the hollow body. Since each group of scrapers or each scraper is capable of overcoming an obstacle individually, the other scrapers continue to scrape even if some of them are momentarily raised in order to pass an obstacle.

Arranging a plurality of scrapers in extension of each other transversely relative to a cleaning direction of the apparatus over a major portion of the width of the hollow body allows the distribution of the scrapers to be optimized in order to provide efficient cleaning of the immersed surface by the apparatus. According to the invention, there is nothing to prevent one or more rows of scrapers from being arranged one after the other in a cleaning direction of the apparatus. However, there is also nothing to prevent scrapers from being arranged in continuation transversely and, for example, a scraper from being longitudinally offset relative to another which is transversely adjacent thereto.

A protruding member according to the invention may be a member for cleaning the immersed surface by means of friction which is different from a scraper.

In particular, advantageously and according to the invention, at least one protruding member is a cleaning brush which is provided in order to brush over the immersed surface and comprises at least one anti-blocking member which is associated with and in front of each cleaning brush.

One or more brush(es) may be used alone or in addition to one or more scraper(s) for the cleaning of the immersed surface.

In all cases, advantageously and according to the invention, at least one anti-blocking member associated with a protruding member for cleaning by means of friction is provided so that, when the protruding member rubs on the immersed surface, this anti-blocking member is located entirely beyond the immersed surface by a predetermined non-zero distance (h1).

Such an anti-blocking member maintained at a minimum distance does not roll permanently on the immersed surface and thus does not impair the scraping and/or the brushing of said immersed surface. The scraping and/or the brushing of the immersed surface involves the scraper (or the brush) applying a force normal to the immersed surface. The fact that the anti-blocking member is held at a minimum distance prevents it from lifting the scraper(s) (or the brush(es)) at the front of which it is mounted when it passes over contamination at the base. In this manner, the cleaning of the immersed surface by such an apparatus is improved.

Furthermore, such an anti-blocking member held at a minimum non-zero distance from the immersed surface (when it is planar) is less subject to contamination and therefore retains better surface friction and better freedom of rotation, consequently with a greater capacity to roll. Furthermore, the rotational connections of an anti-blocking member become less clogged owing to its distance relative to the immersed surface, which also contributes to retaining the rolling capacity of the anti-blocking member.

In particular, advantageously and according to the invention, at least one protruding member is a guiding wall for the liquid which is drawn towards a liquid inlet, said guiding wall extending so as to protrude from the base from an edge portion of said liquid inlet.

The first function of such a wall is to guide the liquid towards the liquid inlet of the hollow body of the apparatus, within which it will then be filtered.

Such a guiding wall is sometimes also called a confinement wall in that it allows the suction of the liquid to be confined to specific orientations. This confinement equally well allows the liquid to be guided towards the liquid inlet and allows the suction power to be intensified in some orientations.

Furthermore, an anti-blocking member according to the invention may have different forms. Such an anti-blocking member may thus have annular and/or longitudinal grooves. In the same manner, the diameter of the notional cover thereof may vary along the rotation axis thereof. Finally, it may be produced from a material which is more or less soft. Each anti-blocking member must be able to roll over an obstacle.

In particular, an apparatus according to the invention advantageously has at least one anti-blocking member which comprises a plurality of discs which are coaxial about the rotation axis, parallel with each other and spaced apart from each other.

Such an anti-blocking member has a number of advantages. If the discs are sufficiently laterally close to each other, the anti-blocking member allows all obstacles to be passed having a width greater than the gap between two consecutive discs and, statistically, a given number of obstacles having a width smaller than this gap if the obstacle is on the path of a disc and not the gap. Such an anti-blocking member constituted by an assembly of discs is also less costly in terms of material and lighter, which is particularly advantageous on a self-propelled apparatus having low driving power.

Furthermore, an anti-blocking member whose cover is cylindrical generated by means of revolution about the rotation axis thereof and whose diameter does not vary along the rotation axis thereof is easy to produce and rolls equally well in a similar manner over all the obstacles encountered.

Advantageously and according to the invention, an apparatus for cleaning an immersed surface further comprises a device for pumping the liquid in the hollow body; at least one liquid outlet out of the hollow body, located remotely from the base of said hollow body; a hydraulic circuit which is configured for ensuring, when said pumping device is active, a circulation of liquid between at least one liquid inlet and at least one liquid outlet, through at least one filtering device which is accommodated in the hollow body.

In particular, a pumping device according to the invention comprises at least one axial pumping propeller having a unidirectional pitch which creates a flux of liquid which is generally orientated along the rotation axis thereof, and which is inserted in said hydraulic circuit, each pumping propeller being configured, in a first rotation direction, for generating a pumping flow between each liquid inlet and each liquid outlet.

A cleaning apparatus according to the invention may in particular comprise at least one liquid outlet which has an orientation which is different from an orientation perpendicular to the immersed surface. In this manner, advantageously, such a liquid outlet may be used for the purposes of propulsion in addition to or in place of the driving device of the apparatus having an electric motor. For example, such a liquid outlet may be directed in an orientation which forms an angle which is different from 90° with the immersed surface and which is inclined towards the rear of the apparatus in a preferred movement direction of the apparatus.

In one possible and advantageous embodiment, an apparatus according to the invention comprises a single reversible electric driving and pumping motor which is carried by said hollow body and which comprises a drive shaft which is connected mechanically to drive wheels in order to be able to rotatably drive them in one direction or the other, and to a pumping propeller in order to be able to rotatably drive it in one direction or the other. Advantageously and according to the invention, the motor comprises a body which is mounted in a longitudinal plane with the drive shaft inclined in an upward orientation and towards the rear by an angle, relative to the plane on which the apparatus rolls, greater than 0° and less than 90°, in particular between 30° and 75°, for example, in the order of 50°.

There is nothing to prevent a plurality of pumping propellers from being provided in the same apparatus according to the invention. Preferably, however, an apparatus according to the invention advantageously comprises a single pumping propeller which is directly mounted axially on an end of the drive shaft which acts as a rotation shaft for this propeller. Advantageously and according to the invention, the pumping propeller is coupled to an upper rear end of the drive shaft which opens at one side of the body of the motor and another lower front end of the drive shaft opens at the other side of the body of the motor and is coupled to a bevel gear which drives two front coaxial half-shafts which are coupled to a single front drive axle.

The invention also relates to an apparatus which is characterized in combination by all or some of the features set out above or below.

BRIEF DESCRIPTION OF THE DRAWINGS

Other objectives, features and advantages of the invention will be appreciated from a reading of the following description, given by way of non-limiting example and with reference to the appended drawings, in which.

DETAILED DESCRIPTION

Figure 4:
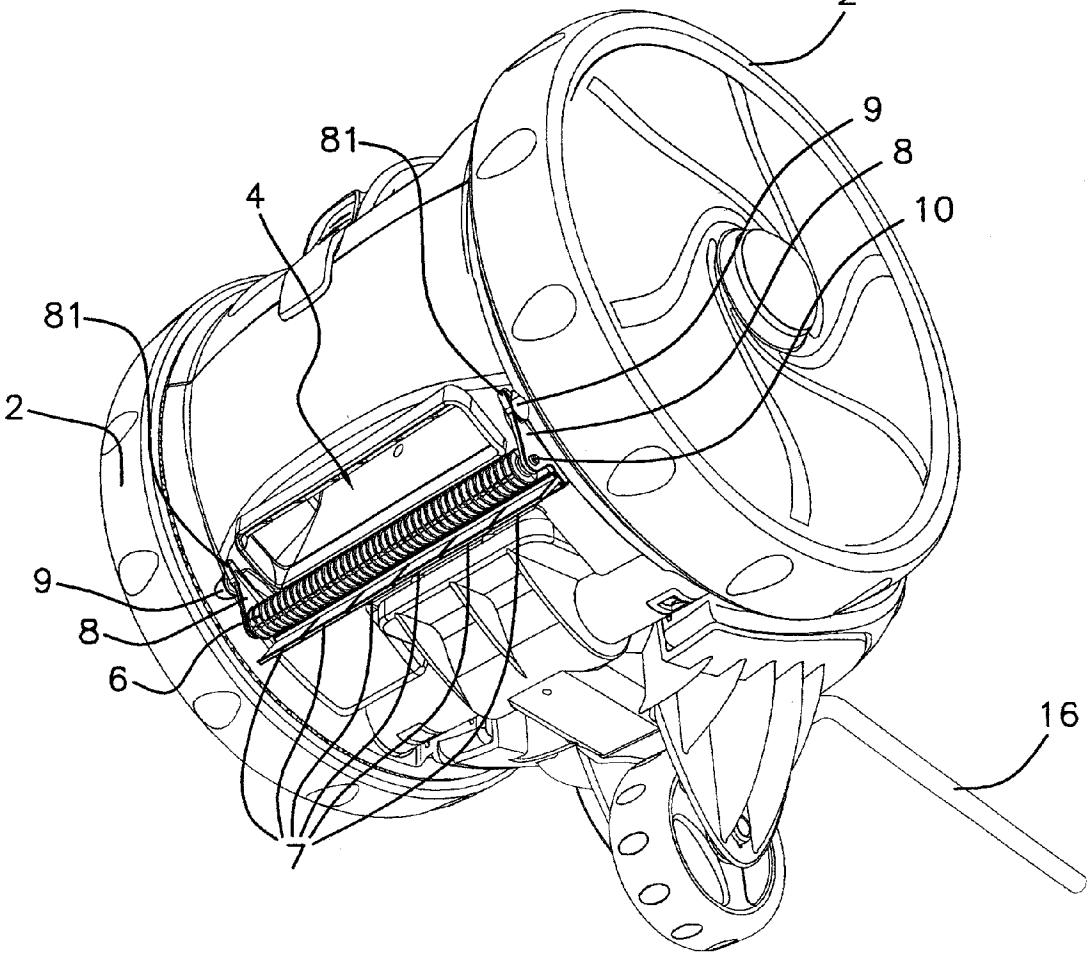
FIG. 4 is a lateral, perspective schematic view of the bottom of an apparatus according to the embodiment set out in FIG. 3.
Figure 5:
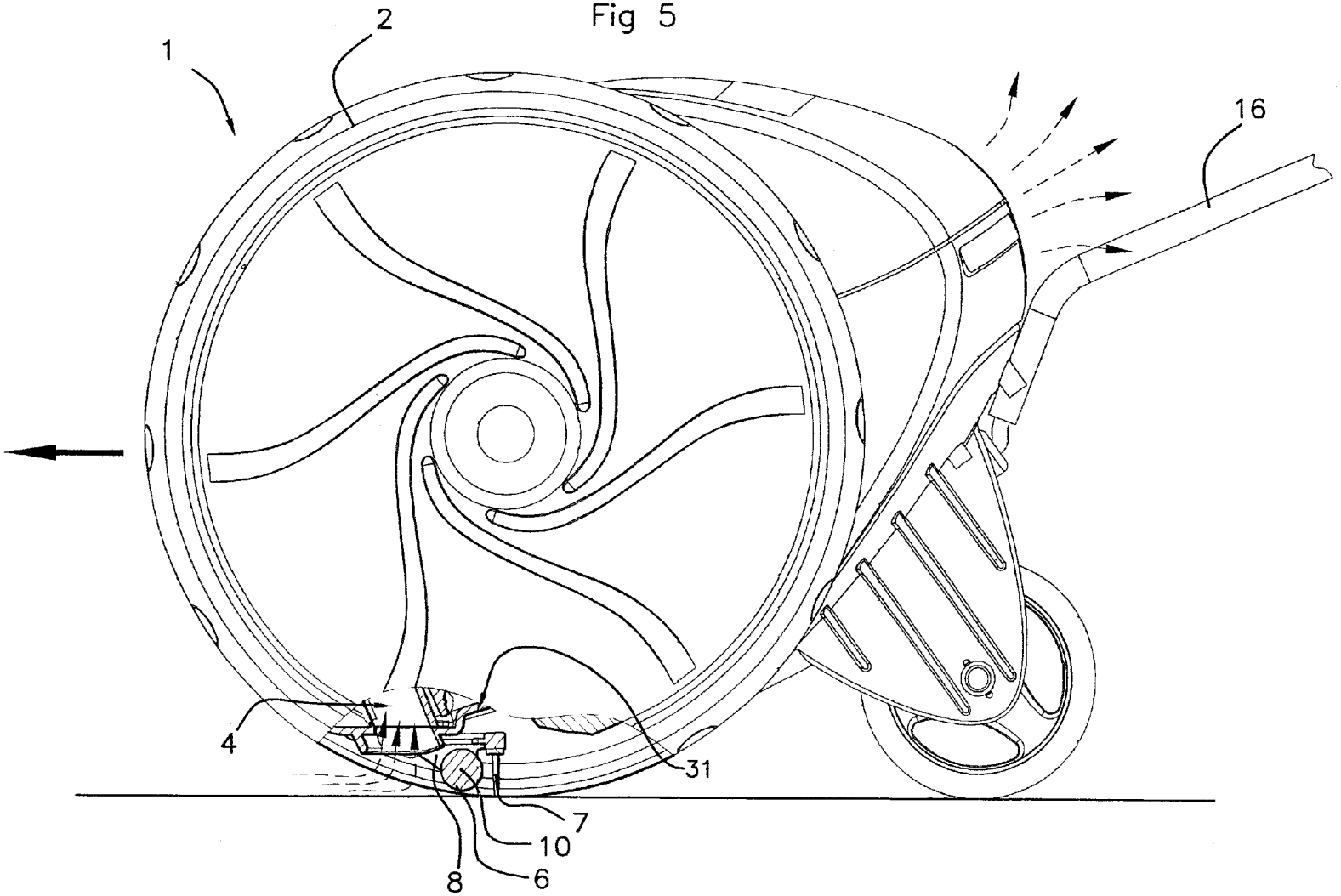
FIG. 5 is a side view of an apparatus according to the embodiment set out in FIGS. 3 and 4, one portion of which is broken away in order to expose the portion characterizing an apparatus according to the invention in section in a vertical longitudinal plane.

An apparatus according to the variant of the invention set out in FIGS. 4 and 5 has three wheels, including two large wheels 2 which have the function of driving the apparatus over an immersed surface. These large wheels 2 are arranged at one side and the other of the hollow body 1 of the apparatus and they are centred on the same transverse axis.

The driving orientation is the "longitudinal" orientation which is defined by the arrangement of the wheels 2; it is substantially orthogonal to the axis of the wheels 2.

In the remainder of the text, "the front" and "the rear" are defined relative to a preferred driving direction of the apparatus in a longitudinal orientation, this preferred direction corresponding to a main cleaning direction of the immersed surface. In FIGS. 1, 2*a*, 2*b*, 2*c* and 5, the main cleaning direction corresponds to a movement of the apparatus over the immersed surface from right to left.

In the remainder of the text, the notions of "lower portion" and "upper portion", "lower" and "upper", "below" and "above" are defined relative to an axis orthogonal to the plane of the immersed surface on which the apparatus according to the invention illustrated in FIGS. 1, 2*a*, 2*b*, 2*c* and 5 moves, the apparatus arbitrarily being assumed to be above the immersed surface.

The apparatus according to the invention in the Figures is a self-propelled apparatus for cleaning an immersed surface comprising a hollow body 1 which has a base 3, a liquid inlet 4, a guiding and driving device 2.

The apparatus also has, within the hollow body, a hydraulic circuit which allows the liquid inlet 4 to be connected to the liquid outlet 5. This circuit comprises in particular a liquid filtering device 12 and a liquid pumping device 13. Each of the liquid filtering device 12 and liquid pumping device 13 may be of different types. The filtering device 12 may be active, that is to say, comprise movable elements which can be used for the filtration (for example, a centrifuge), or passive, that is to say that it filters the liquid which is moved by another device. In particular, the pumping device 13 may have at least one propeller, which allows a liquid flux to be created which is orientated in one direction in an orientation which is substantially parallel with the rotation axis of the propeller.

Figure 3:
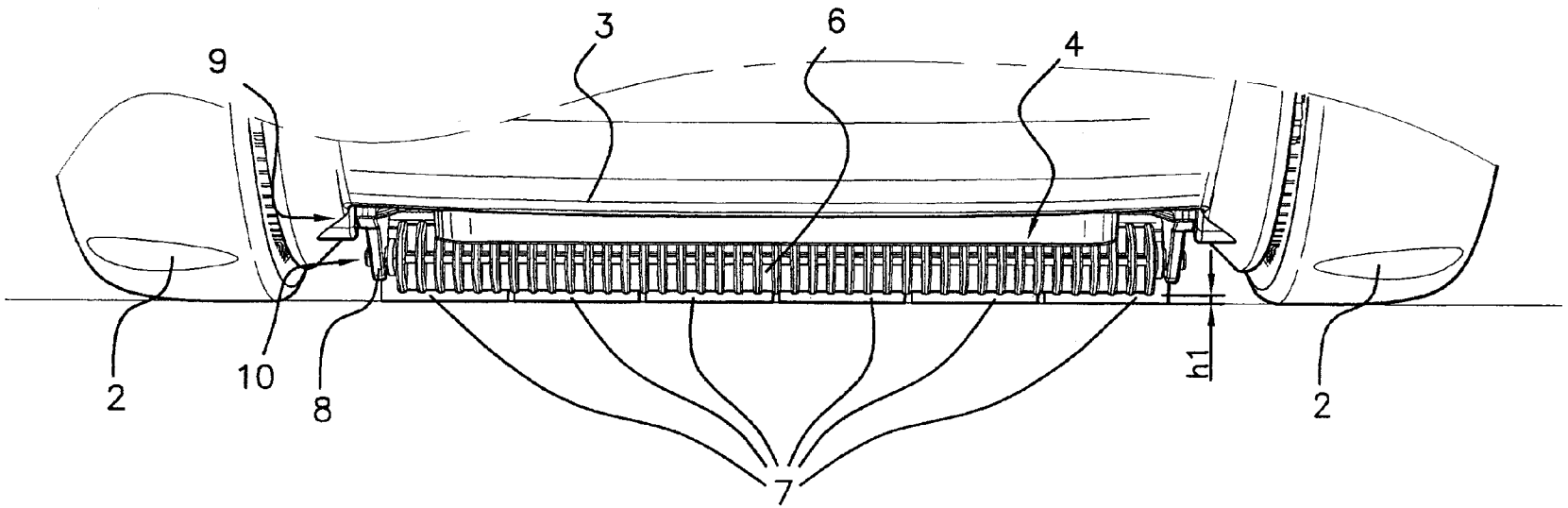
FIG. 3 is a partial schematic view of the base of an apparatus according to the invention in a specific embodiment, viewed from the front relative to the normal direction before cleaning.

The apparatus according to the invention in FIGS. 3 to 5, is a self-propelled apparatus for cleaning the immersed surface comprising a series of scrapers 7 which protrude from the hollow body and an anti-blocking member 6.

The series of scrapers 7 is arranged just at the rear of the liquid inlet 4 in the cleaning direction. Such scrapers 7 are laterally one in continuation of the other over the major portion of the width of the apparatus. During normal operation, that is to say, when the apparatus is rolling over an immersed surface which is locally substantially smooth and without obstacles, the scrapers 7 scrape the immersed surface. Their function is to remove the contamination bonded to the immersed surface, in particular the contamination which would not be drawn in by the flux of liquid created inside the hollow body. By removing the contamination from the immersed surface, the scrapers place the contamination in suspension in the liquid and it is more readily drawn in by the apparatus.

Furthermore, owing to their shape, the scrapers 7 perform a function equivalent to a confinement wall at the rear of the liquid inlet 4. The suction of liquid is thus confined in the zone located at the front of the scrapers 7. This confinement has the effect of improving the suction by limiting the arrival orientations of the liquid towards the liquid inlet 4, and therefore increasing the speed of the liquid drawn in. This higher speed allows better cleaning since contamination with greater inertia can be recovered.

The scrapers 7 are mounted on a common support 8. Advantageously, according to a specific embodiment of the invention illustrated in FIG. 6, the scrapers 7 are moulded in the common support 8. When the common support 8 is produced from a hard material, in particular from a rigid plastics material, and the scrapers 7 are produced from a soft material, in particular a flexible plastics material, in particular an elastomer material, it is advantageous in terms of production to mould the scrapers 7 in the common support 8 in order to ensure optimal mechanical connection between the common support 8 and scrapers 7.

This common support 8 is rotatably articulated relative to the hollow body along a tilting axis 9 which is substantially orthogonal to the driving orientation. This tilting is limited in one direction and in the other by two stops. One of the two stops is a lower stop 32 which prevents the common support from leaving the hollow body to an excessive extent; the second is an upper stop 31 which prevents the common support from becoming excessively retracted in the hollow body. Consequently, the tilting of the common support 8 about the axis thereof from one stop to another is limited to an angular extent of less than 90°, preferably less than 60°, for example in the order of 20°.

The lower stop 32 has, in particular, the advantage of limiting the withdrawal of the common support 8 and the elements which it supports from the hollow body 1 when the apparatus is raised from the immersed surface and handled by a user. Limiting the withdrawal of these elements from the hollow body allows, inter alia, the exposure thereof to be limited and therefore the risks of them becoming damaged to be limited.

Such a lower stop 32, according to an advantageous embodiment of the invention, is produced simply by extending the common support beyond the tilting axis 9 thereof, towards the front. This extension 81 of the common support tilts upwards when the main portion of the common support 8 tilts downwards, and moves into abutment against the base 3 of the hollow body located at the front of the tilting axis 9. Owing to the presence of such an extension 81, the base 3 of the hollow body therefore performs the function of a lower stop 32.

Advantageously and according to an alternative embodiment in accordance with the invention, the lower stop 32 may be produced in the base of the hollow body, below the tilting axis 9, and at the rear of the tilting axis 9 in a preferred movement direction of the apparatus. In this manner, the lower and rear portion of the common support 8 in a preferred movement direction of the apparatus on an immersed surface moves into abutment against this lower stop 32 when the common support 8 tilts downwards.

The upper stop 31 particularly has the advantage of retaining the anti-blocking member 6 outside the hollow body 1 so that it rolls over the obstacle which is responsible for raising the common support 8. In this manner, such an upper stop 31 prevents the common support from overturning or from becoming blocked inside the hollow body.

A second function of an upper stop 31 according to the invention is to allow at least a portion of the apparatus that is different from the common support 8 to be raised by passing an anti-blocking member 6. In particular, as illustrated in FIG.

6, when an obstacle with significant height is passed (that is to say, greater than h1 supplemented by the tilting of the common support as far as the upper stop), a wheel 2 can be raised from the immersed surface. When the obstacle is passed, the anti-blocking member rolls over the obstacle, the common support tilts upwards and reaches the upper stop thereof but, since the obstacle has not yet been overcome, the anti-blocking member continues to climb on the obstacle and a wheel 2 is lifted from the immersed surface. The position of the apparatus is unbalanced by the obstacle having a smaller width than the distance between the two wheels 2 thereof and remains supported on only one of the two wheels 2 which continues to ensure the driving of said apparatus over the immersed surface.

An upper stop 31, according to an advantageous embodiment of the invention, is produced simply by allowing the upper portion of the common support 8 to move into abutment on the base 3 of the hollow body 1. In particular, when the hollow body has a recess which allows the common support 8 to tilt towards the inner side of the hollow body 1, the base surface 31 of this recess, facing the upper portion of the common support, acts as an upper stop 31.

The base surface 31 of this recess with which the common support 8 moves into abutment in a tilting direction may have various surface appearances. Advantageously and according to a specific embodiment of the invention, this surface has longitudinal ribs which allow the total contact surface with the common support 8 to be minimized when it moves into upper abutment 31.

Figure 6:
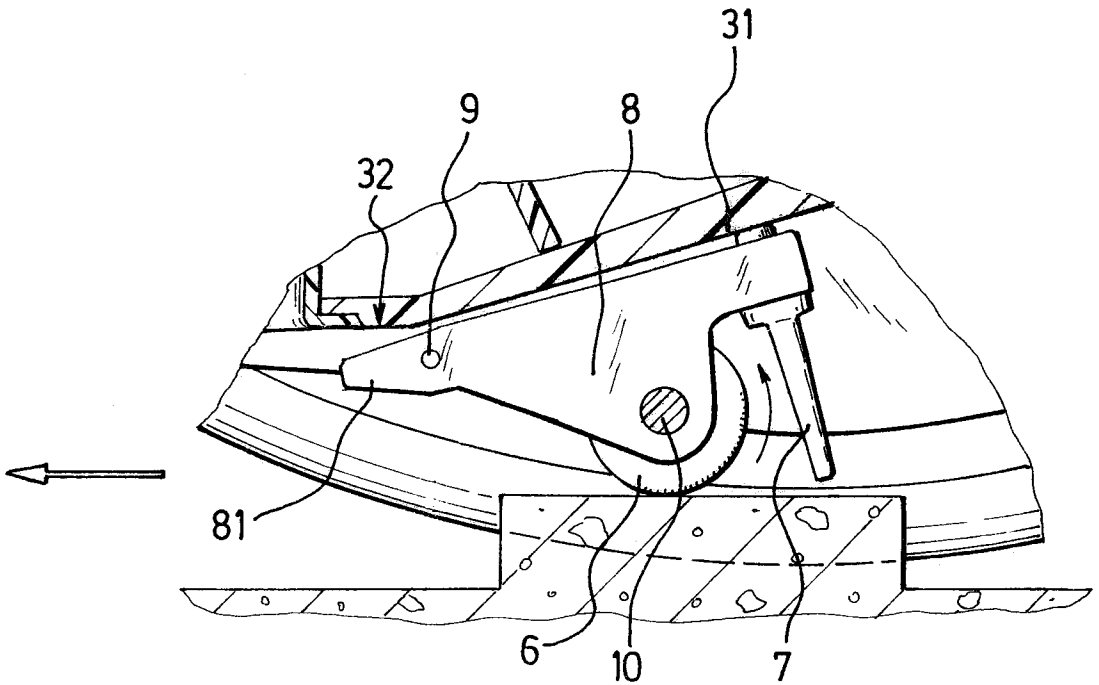
FIG. 6 is a side view of an apparatus according to the embodiment set out in FIGS. 3, 4 and 5, illustrating the portion characterizing an apparatus according to the invention in section in a longitudinal vertical plane, at the time an obstacle of the immersed surface is passed by the apparatus, the obstacle having an apparent width in the movement direction of the apparatus which is less than the width between the wheels 2.

Furthermore, in this specific embodiment, and when the scrapers 7 are moulded from a flexible plastics material in a rigid common plastics support 8, it is advantageous to mould the scrapers 7 in such a manner that they also extend outside the common support on the upper portion thereof, as illustrated in FIG. 6. In this manner, the scrapers create a protuberance of flexible material on the upper portion of the common support 8. In this manner, the risks of fracture and/or wear owing to the repeated impacts between the upper portion of the common support and the base of the hollow body (in particular the base surface 31 of the recess) during a blockage of the tilting into upper abutment 31 are limited. Furthermore, the sound during a contact between the common support and base of the hollow body is damped and provides a sensation of quality.

The apparatus according to the embodiment of the invention illustrated in FIGS. 1 to 5 also comprises a single anti-blocking member 6 which extends over a major portion of the width of the scrapers and the support, in particular of the apparatus. The anti-blocking member 6 is capable of rolling over the immersed surface in that it has a rounded profile and can rotate freely about the rotation axis 10.

Said anti-blocking member 6 is immediately in front of the scrapers 7 and is mounted with the scrapers on the common support 8.

In particular, the anti-blocking member 6 has an outer surface which is cylindrical generated by means of revolution about the rotation axis 10. The advantages of this shape are the ease of production and optimized rolling functionality.

When viewed from the front, as in FIG. 3, the anti-blocking member 6 according to this specific embodiment of the invention comprises an assembly of discs which are spaced apart by regular intervals. This embodiment has the advantage of saving material and a lower weight of the anti-blocking member. Furthermore, the obstacles having to be overcome by the scrapers 7 generally have an apparent width greater than the gap between two consecutive discs. Such is, for example, the case commonly encountered with a bottom plug.

Preferably, an anti-blocking member 6 which has a plurality of discs is formed by only one component. This arrangement allows, on the one hand, the production and the replacement of such an anti-blocking member to be made economical. On the other hand, independent discs would have a greater risk of becoming damaged.

So that the anti-blocking member 6 is not in contact with the immersed surface when the apparatus is moving normally over an immersed surface which is locally smooth and which has no significant obstacle, the anti-blocking member is advantageously kept at a minimum height h1 from the immersed surface; that is to say that the lowest point of the anti-blocking member is at a minimum height h1 from the immersed surface. The advantage of such an arrangement of the anti-blocking member is principally not to impede the scraping of contamination by the scrapers 7, or the suction via the liquid inlet 4 of that same contamination placed in suspension in the liquid by the scraping of the scrapers.

Placing the anti-blocking member 6 at a minimum height h1 has the advantage of preventing it from rolling over contamination encountered, thus raising the scrapers from the immersed surface and directly affecting the cleaning quality since they no longer scrape or in any case no longer scrape as efficiently.

Furthermore, an anti-blocking member which is kept at a non-zero distance (h1) from the immersed surface, which is a priori dirty, is less subject to contamination and retains better surface friction and therefore greater rolling capacity. It is also less easily blocked in terms of rotation owing to contamination.

Finally, h1 must be such that, having taken into consideration the driving power of the apparatus and the rigidity of the scrapers and/or any protruding member, the apparatus is not blocked by an obstacle having a height less than h1.

Figure 1:
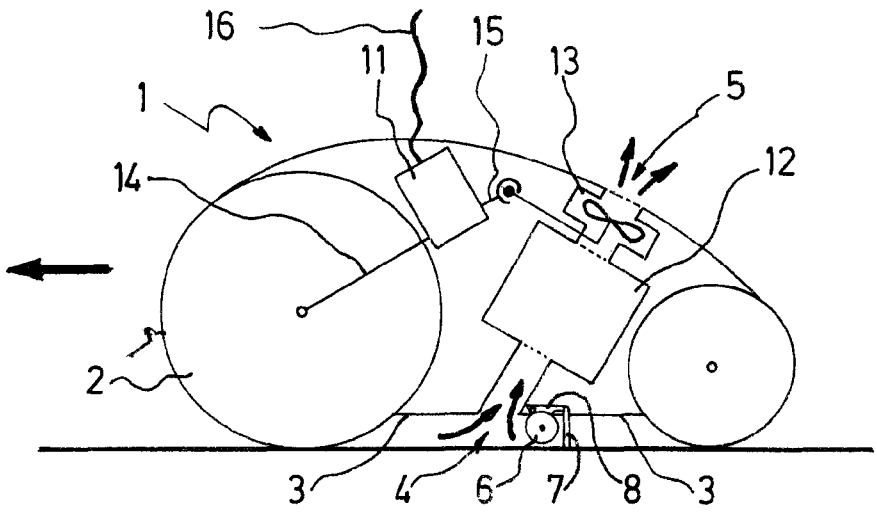
FIG. 1 is a schematic view of an apparatus according to the invention, sectioned in a vertical longitudinal plane.
Figure 2A:
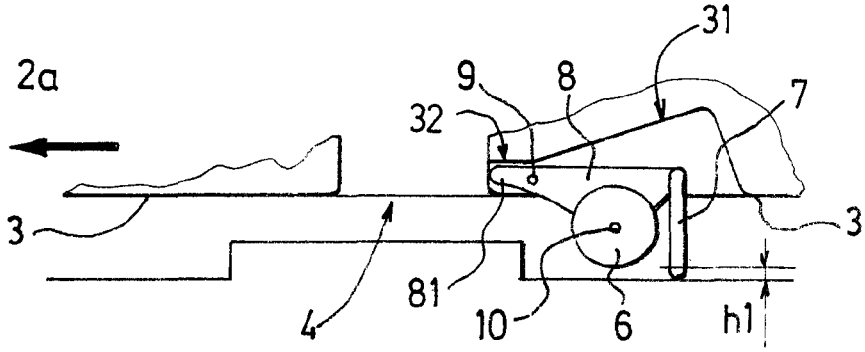
FIGS. 2*a*, 2*b* and 2*c* are partial schematic views of the base of an apparatus according to the invention, sectioned in a vertical longitudinal plane; they show the implementation step by step of the characterizing portion of the invention when an assembly of scrapers in lateral continuation of each other passes above an obstacle located on the immersed surface.
Figure 2B:
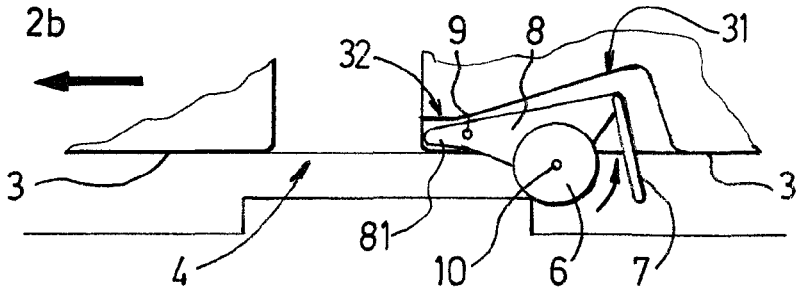
Figure 2C:
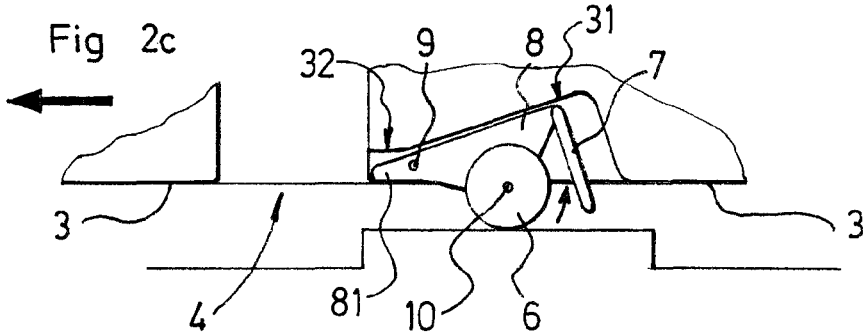

The operating method of the invention is shown in FIGS. 2*a* to 2*c*.

In FIG. 2*a*, an obstacle having a height greater than h1 can be seen at the front of the scrapers 7.

In FIG. 2*b*, the anti-blocking member which is located at the front of the scrapers is the first to touch the obstacle. From the time when the anti-blocking member is in frictional contact with the obstacle, it begins to roll thereon. Furthermore, the common support tilts in the orientation of the upper stop 31 thereof.

In FIG. 2*c*, the anti-blocking member rolls over the surface of the obstacle. In accordance with the height of the obstacle and h1, the scraper will or will not begin to scrape the surface of the obstacle.

The anti-blocking member 6 allows an obstacle to be overcome which would otherwise block the apparatus for cleaning an immersed surface owing to the blockage of the scrapers 7 thereof or any other protruding member on the obstacle in question.

The anti-blocking member is in particular necessary to allow the protruding members to pass the rising portion of the obstacle.

The invention is used in particular when the apparatus for cleaning an immersed surface comprises a single electric motor which is used both for the driving thereof on the immersed surface and for the circulation of the liquid therein. Since such an apparatus has only a low driving power on the immersed surface, the presence of an anti-blocking member in front of each protruding member such as scrapers is particularly advantageous.

An apparatus for cleaning an immersed surface according to this embodiment of the invention comprises a single electric motor 11 which allows driving members, such as wheels 2, and a pumping member 13, such as a propeller 13, to be driven by means of a mechanical drive transmission 14 and a mechanical pumping transmission 15, respectively. The electric motor 11 being supplied with electrical power and optionally controlled by means of an electric cable 16.

The invention may relate to numerous production variants compared with the embodiment illustrated in the Figures and described above. In particular the driving device of the apparatus may be hydraulic instead of being electric, and may use a flow of liquid which is created by a pumping device external with respect to the invention.

The electric motor itself is not necessarily supplied with electrical power by an electric cable which is connected to an energy supply unit external with respect to the apparatus, but the apparatus may carry on board or produce its own energy (battery, solar panels, etc.).

The members which allow the apparatus to be driven over the immersed surface may be of any other type: wheels, tracks, rollers, etcetera . . . . The apparatus may be driven over the immersed surface by any combination of these members.

In the same manner, the filtration circuit may be produced in many different manners and may in particular comprise a plurality of filtration and suction members.

Furthermore, the scrapers are not necessarily in continuation of each other. In the same manner, the cleaning function of the immersed surface may be performed by a single scraper in place of a plurality of scrapers. Finally, the protruding cleaning members are not necessarily scrapers but may be of a different type, for example, brushes.

Furthermore, protruding members of the base 3 of the hollow body 1 are not necessarily cleaning members; this may be, for example, a wall for confinement of the suction of liquid.

The anti-blocking member itself is not necessarily alone. The apparatus may have a multiplicity of anti-blocking members, for example, each being positioned at the front of a scraper.

In the same manner, an anti-blocking member may be of multiple types and in particular may have different forms. In this manner, the anti-blocking member does not necessarily have a notional cylindrical cover generated by means of revolution about the rotation axis 10, but it may have a cover whose profile has a variable diameter along the rotation axis 10 thereof. Furthermore, the anti-blocking member may have annular grooves, longitudinal grooves or any other surface forms which are considered to be advantageous.

The anti-blocking member may be rolling permanently over the immersed surface during the cleaning thereof, h1 being reduced to zero.

An apparatus according to the invention may have a support 8 which is common to all of the protruding members and all of the anti-blocking members or a plurality of common supports 8 which each support one or more protruding members and one or more anti-blocking members.

Furthermore, such a common support 8 is not necessarily articulated relative to the hollow body 1. If h1 is reduced to zero, or if the driving power of the apparatus is sufficient to allow its protruding members to pass an obstacle having a height h1, the tilting of said common support 8 is not necessary.

Furthermore, a common support 8 according to the invention does not necessarily tilt all of the protruding member(s) and anti-blocking member(s) when an obstacle is passed by means of rotation about a tilting axis 9. In this manner, a common support 8 according to the invention may move in accordance with a translation movement or any movement when passing the obstacle. Furthermore, the lower and upper stop(s) are not necessarily moulded in the hollow body but may involve an added component, given that it is mounted so as to be integral with the hollow body.

An apparatus for cleaning an immersed surface according to the invention may have a plurality of liquid inlets, a plurality of liquid outlets and optionally a plurality of filtration circuits.

The invention claimed is:

1. A self-propelled apparatus for cleaning an immersed surface, comprising:

a. a body defining (i) a liquid inlet and (ii) a base;

b. means for moving the body along the immersed surface in a travel direction;

c. a protruding member extending from the base toward the immersed surface;

d. an anti-blocking member (i) positioned in front of the protruding member in the travel direction, (ii) rotatable about a rotation axis fixed relative to the protruding member, and (iii) configured so as to be able to (A) roll over an obstacle of the immersed surface and (B) move the protruding member relative to the body in order to overcome the obstacle; and e. a common support for the protruding member and the anti-blocking member configured to be articulated relative to the body along a tilting axis substantially parallel to the rotation axis.

2. A self-propelled apparatus according to claim 1 further comprising a lower stop and an upper stop configured to limit angular extent of articulation of the common support.

3. A self-propelled apparatus according to claim 1 in which (a) the liquid inlet is at the base and (b) the protruding member is positioned behind the liquid inlet in the travel direction.

4. A self-propelled apparatus according to claim 1 in which the protruding member comprises a scraper configured to scrape the immersed surface.

5. A self-propelled apparatus according to claim 1 in which (a) the body further defines a width and (b) the protruding member comprises a plurality of scrapers extending substantially transverse to the travel direction over a major portion of the width of the body.

6. A self-propelled apparatus according to claim 1 in which the protruding member comprises a cleaning brush configured to brush the immersed surface.

7. A self-propelled apparatus according to claim 1 in which the protruding member is configured at times to contact the immersed surface while the anti-blocking member is above the immersed surface.

8. A self-propelled apparatus according to claim 1 in which the body further defines a liquid outlet remote from the base, the apparatus further comprising:

a. a pump positioned at least partly in the body;

b. a filter accommodated in the body; and c. a hydraulic circuit configured for ensuring, when the pump is operating, a circulation of liquid between the liquid inlet and the liquid outlet through the filter.

9. A self-propelled apparatus for cleaning an immersed surface, comprising:

a. a body defining (i) a base; and (ii) a liquid inlet at the base and having an edge portion;

b. means for moving the body along the immersed surface in a travel direction;

c. a protruding member (i) extending from the base toward the immersed surface and (ii) defining a guiding wall for liquid drawn toward the liquid inlet, the guiding wall extending so as to protrude from the base from the edge portion of the liquid inlet; and d. an anti-blocking member (i) positioned in front of the protruding member in the travel direction, (ii) rotatable about a rotation axis fixed relative to the protruding member, and (iii) configured so as to be able to (A) roll over an obstacle of the immersed surface and (B) move the protruding member relative to the body in order to overcome the obstacle.

10. A self-propelled apparatus for cleaning an immersed surface, comprising:

a. a body defining (i) a liquid inlet and (ii) a base;

b. means for moving the body along the immersed surface in a travel direction;

c. a protruding member extending from the base toward the immersed surface; and d. an anti-blocking member (i) positioned in front of the protruding member in the travel direction, (ii) rotatable about a rotation axis fixed relative to the protruding member, (iii) configured so as to be able to (A) roll over an obstacle of the immersed surface and (B) move the protruding member relative to the body in order to overcome the obstacle, and (iv) comprising a plurality of discs (A) coaxial about the rotation axis, (B) parallel with each other, and (C) spaced apart from each other.

* * * * *